US011222546B2

(12) United States Patent
Garai et al.

(10) Patent No.: US 11,222,546 B2
(45) Date of Patent: Jan. 11, 2022

(54) PAIRING AIRCRAFT DURING FLIGHT

(71) Applicant: Airbus SAS, Bristol (GB)

(72) Inventors: Tanushree Garai, Bristol (GB); Srushti Virdhe, Bristol (GB); Akshay Bansal, Bristol (GB)

(73) Assignee: Airbus SAS, Bristol (GB)

( * ) Notice: Subject to any disclaimer, the term of this patent is extended or adjusted under 35 U.S.C. 154(b) by 342 days.

(21) Appl. No.: 16/355,046

(22) Filed: Mar. 15, 2019

(65) Prior Publication Data

US 2019/0287412 A1 Sep. 19, 2019

(30) Foreign Application Priority Data

Mar. 16, 2018 (IN) ..... 201841009812

(51) Int. Cl.
*G08G 5/00* (2006.01)

(52) U.S. Cl.
CPC ..... *G08G 5/0039* (2013.01); *G08G 5/0008* (2013.01); *G08G 5/0021* (2013.01); *G08G 5/0047* (2013.01)

(58) Field of Classification Search
CPC ..... G08G 5/0039; G08G 5/0047; G01P 5/26; G01W 1/10; G01W 2001/003; G01S 17/89; G01S 17/95; G06N 3/08; G06N 20/00; Y02A 90/10
See application file for complete search history.

(56) References Cited

U.S. PATENT DOCUMENTS

| | | | | |
|---|---|---|---|---|
| 8,731,812 | B2 * | 5/2014 | Bushnell | G01C 23/005 701/122 |
| 2005/0230563 | A1 * | 10/2005 | Corcoran | G05D 1/104 |
| 2011/0066360 | A1 * | 3/2011 | Haissig | 701/116 |
| 2017/0076614 | A1 | 3/2017 | Shay | |
| 2017/0229029 | A1 * | 8/2017 | Klinger | G01S 13/02 |
| 2018/0004250 | A1 * | 2/2018 | Sawhill et al. | G08G 5/0043 |
| 2018/0240348 | A1 * | 8/2018 | Ren | G08G 5/025 |

FOREIGN PATENT DOCUMENTS

| | | |
|---|---|---|
| EP | 2 051 151 | 4/2009 |
| WO | 2016/022646 | 2/2016 |

OTHER PUBLICATIONS

Search Report for GB1807290.0 dated Sep. 28, 2018, 10 pages.

* cited by examiner

*Primary Examiner* — Jason Holloway
(74) *Attorney, Agent, or Firm* — Nixon & Vanderhye P.C.

(57) ABSTRACT

An on-board computing apparatus and associated methods that process aircraft data gathered from aircraft, such as during flight of these aircraft, to pair aircraft during at least portions of a flight route. This enables collaborative airspace management. In certain cases, paired aircraft may be controlled to fly in formation, e.g. flown to maintain a defined separation distance within two- or three-dimensional space over a given period of time. Formation flying in this manner, with pairs of lead and follower aircraft, can allow a follower aircraft to take advantage of a vortex generated by the lead aircraft.

15 Claims, 6 Drawing Sheets

PAIRING AIRCRAFT DURING FLIGHT

RELATED APPLICATION

This application claims priority to Indian patent application IN 201841009812, filed 16 Mar. 2018, the entirety of which is incorporated by reference.

TECHNICAL FIELD

The present invention relates to pairing aircraft based on aircraft data such that they may fly in formation. In certain examples, the present disclosure relates to on-board computing apparatus and methods of control for aircraft.

BACKGROUND

The number of aircraft occupying airspace is steadily increasing. These aircraft include large passenger aircraft, private craft including light aircraft and helicopters, and automated vehicles such as small drones. Many of these aircraft types have flight control systems that control the aircraft during flight, e.g. based on a predefined flight plan and/or manual inputs. As airspace becomes more crowded, there is a need for systems that enable safe and efficient flight.

In certain cases, aircraft are manually controlled by ground control teams. For example, air traffic control may monitor the progress of aircraft in flight through controlled airspace. Two-dimensional planes of flight may be displayed on a screen or monitor, wherein potential collisions may be manually detected and highlighted. This involves a large degree of planning and clearance. For example, it is a challenge to organise the paths of aircraft during flight to maintain separation. Aircraft flight plans are typically drawn up and submitted to a central authority to ensure that collisions are avoided. For smaller aircraft this may not be practical.

It is thus desired to provide flight control systems that address at least some of these issues.

SUMMARY

A first aspect of the present invention provides an on-board computing apparatus for a primary aircraft comprising: a route engine to provide aircraft data for a route flown by the primary aircraft; a receiver to receive aircraft data for a plurality of secondary aircraft; an aircraft pairing engine to pair the primary aircraft with a secondary aircraft from the plurality of secondary aircraft based on the aircraft data from the route engine and the aircraft data from the receiver, the aircraft pairing engine comprising electronic circuitry to: determine a set of candidate aircraft from the plurality of secondary aircraft based on a route similarity metric, the route similarity metric comprising a function of the aircraft data from the route engine and the aircraft data from the receiver and indicating a similarity of a route flown by one of the plurality of secondary aircraft to the route flown by the primary aircraft; and process flight times for cruise trajectories of the primary aircraft and the set of candidate aircraft determined from the aircraft data from the route engine and the aircraft data from the receiver to output route portions for a subset of the set of candidate aircraft that overlap with the route for the primary aircraft.

Optionally, the on-board computing apparatus comprises a transmitter to transmit an indication of route sharing to one or more of the subset of the set of candidate aircraft.

Optionally, the route engine is to receive the output of the aircraft pairing engine and adjust the route flown by the primary aircraft to fly in formation with one or more of the subset of the set of candidate aircraft.

Optionally, the aircraft pairing engine comprises: a paired-route adjustment engine to select a route portion associated with one of the subset of the set of candidate aircraft and to determine, in conjunction with aircraft data supplied by the route engine, a route adjustment to one or more of the route flown by the primary aircraft and the selected route portion to maintain a predetermined flight separation, for the time of the route portion, between the primary aircraft and the one of the subset of the set of candidate aircraft.

Optionally, the aircraft pairing engine comprises electronic circuitry to compute the route similarity metric based on one or more of, for a given secondary aircraft in the plurality of secondary aircraft: a comparison of an altitude of the primary aircraft with an altitude of the given secondary aircraft; a comparison of an aircraft type of the primary aircraft with an aircraft type of the given secondary aircraft; and a comparison of top-of-climb and top-of-descent times for a cruise trajectory of the primary aircraft with required times of arrival for a cruise trajectory of the given secondary aircraft.

Optionally, the aircraft pairing engine comprises electronic circuitry to perform the following operations to process flight times: sort the cruise trajectories of the set of candidate aircraft based on required times of arrival in the aircraft data from the receiver that are associated with a top-of-descent time for the primary aircraft to generate a list of sorted cruise trajectories; and iteratively process earliest and latest cruise trajectories in the list of sorted cruise trajectories to add route portions computed from the list of cruise trajectories to a list of output route portions based on a maximised time of flight.

Optionally, the receiver and the aircraft pairing engine are activated iteratively during flight of the primary aircraft to output updated route portions for a subset of the secondary aircraft that represent changes in one or more of the aircraft data of the primary aircraft and the aircraft data of the secondary aircraft.

A second aspect of the present invention provides a method of controlling a primary aircraft comprising: obtaining aircraft data for the primary aircraft; obtaining aircraft data for a set of secondary aircraft; filtering the set of secondary aircraft based on a constrained comparison of kinematics for the primary aircraft and the set of secondary aircraft derived from the aircraft data; comparing flight timings for the filtered set of secondary aircraft to flight timings for the primary aircraft to output a set of paired route portions for a subset of the filtered set of secondary aircraft, the paired route portions indicating a potential overlap with a flight route for the primary aircraft; and for a secondary aircraft associated with one or more paired route portions from the set of paired route portions, adjusting the flight parameters of the primary aircraft so as to maintain at least a predefined separation between the primary aircraft and the secondary aircraft for the one or more paired route portions.

Optionally, adjusting the flight parameters of the primary aircraft comprises adjusting one or more of: a flight plan, a speed profile and an altitude profile.

Optionally, the method is repeated during movement of the primary aircraft along the flight route for the primary aircraft.

Optionally, filtering the set of secondary aircraft comprises, for a given secondary aircraft, determining whether one or more of the following constraints are met: that an altitude of the given secondary aircraft is within a threshold distance of an altitude of the primary aircraft; that within a plane of flight, a flight route for the given secondary aircraft is within a threshold distance of a flight route for the primary aircraft; that an aircraft type of the given secondary aircraft is compatible with an aircraft type of the primary aircraft; and that required times of arrival for the secondary aircraft are within a range between a top-of-climb time and a top-of-descent time for the primary aircraft.

Optionally, comparing flight timings comprises: obtaining, from the aircraft data for the primary aircraft, data indicating a top-of-climb time and a top-of-descent time for the primary aircraft; obtaining, from the aircraft data for the secondary aircraft, data indicating required times of arrival for each of the secondary aircraft that are associated with the top-of-climb time and the top-of-descent time for the primary aircraft; ordering the data for the secondary aircraft based on required times of arrival that are associated with the top-of-climb time; and iteratively selecting route portions from the ordered data for the filtered set of secondary aircraft by maximising time periods between merge and break-away points, the merge and break-away points comprising points in time where a route portion for a secondary aircraft overlaps with the flight route for the primary aircraft.

According to a third aspect there is provided a non-transitory computer-readable storage medium storing instructions that, when executed by a processor, cause the processor to: load data relating to a primary aircraft, the data comprising a flight plan, an altitude profile and a speed profile; load data relating to a set of secondary aircraft, the data comprising a flight plan, an altitude profile and a speed profile for each of the set of secondary aircraft; pre-process the data relating to the set of secondary aircraft to generate a time-sorted list of cruise trajectories for a set of candidate aircraft, the set of candidate aircraft comprising a subset of the set of secondary aircraft; process the time-sorted list of cruise trajectories for the set of candidate aircraft to generate a list of route segments for one or more candidate aircraft; and adjust flight plans of one or more of the primary aircraft and a candidate aircraft associated with a given route segment in the list of route segments so as to maintain a predetermined common distance for the given route segment.

Optionally, the medium includes instructions that cause the processor to: select a cruise trajectory within a predetermined threshold of a top-of-climb time from the data relating to a primary aircraft based on a maximum time of flight; for any remaining cruise trajectories in the time-sorted list of cruise trajectories, select a cruise trajectory within a predetermined threshold of a top-of-descent time from the data relating to a primary aircraft based on a maximum time of flight; and for any remaining cruise trajectories in the time-sorted list of cruise trajectories, iteratively truncate timings within the remaining cruise trajectories based on the selected cruise trajectories and select additional cruise trajectories based on a maximum time of flight for the truncated timings, wherein the selected cruise trajectories and their associated secondary aircraft are used to generate the list of route segments.

Optionally, the instructions to adjust flight plans of one or more of the primary aircraft and a candidate aircraft associated with a given route segment comprise instructions that cause the processor to: transmit one or more of an adjusted flight plan, an adjusted altitude profile and an adjusted speed profile to one or more of the primary aircraft and the candidate aircraft.

BRIEF DESCRIPTION OF THE DRAWINGS

Embodiments of the invention will now be described, by way of example only, with reference to the accompanying drawings, in which.

DETAILED DESCRIPTION

In the following description, for purposes of explanation, numerous specific details of certain examples are set forth. Reference in the specification to "an example" or similar language means that a particular feature, structure, or characteristic described in connection with the example is included in at least that one example, but not necessarily in other examples.

Certain methods and systems described herein relate to the pairing of aircraft during flight, e.g. such that multiple aircraft may be efficiently controlled in a common airspace. In examples described herein, references to "aircraft" include all kinds of aircraft, such as fixed wing, for example military or commercial aircraft, or unmanned aerial vehicles (UAVs), and rotary wing aircraft, for example helicopters.

Certain examples described herein process aircraft data that is gathered from aircraft, such as during flight of these aircraft, to pair aircraft during portions of a flight route. This enables collaborative airspace management. In certain cases, paired aircraft may be controlled to fly in formation, e.g. flown to maintain a defined separation distance within two- or three-dimensional space over a given period of time. Formation flying in this manner, with pairs of lead and follower aircraft, can allow a follower aircraft to take advantage of a vortex generated by the lead aircraft. This can result in fuel savings for the follower aircraft. The examples described herein enable appropriate pairs of aircraft to be identified for this formation flying based on shared aircraft data. Identifying pairs of aircraft may also reduce a control burden borne by air traffic control systems, as flight routes of aircraft may be controlled in a peer-to-peer manner. Examples may be applied as part of aircraft flight control systems and may operate dynamically, i.e. over time, to accommodate changing aircraft and airspace states, e.g. due to manual control of aircraft and/or changes due to weather or atmospheric effects. By pairing aircraft and maintaining a safe separation distance between the paired aircraft, airspace may be more efficiently utilized, accommodating increased aircraft numbers and aircraft density for busy airports.

Figure 1:
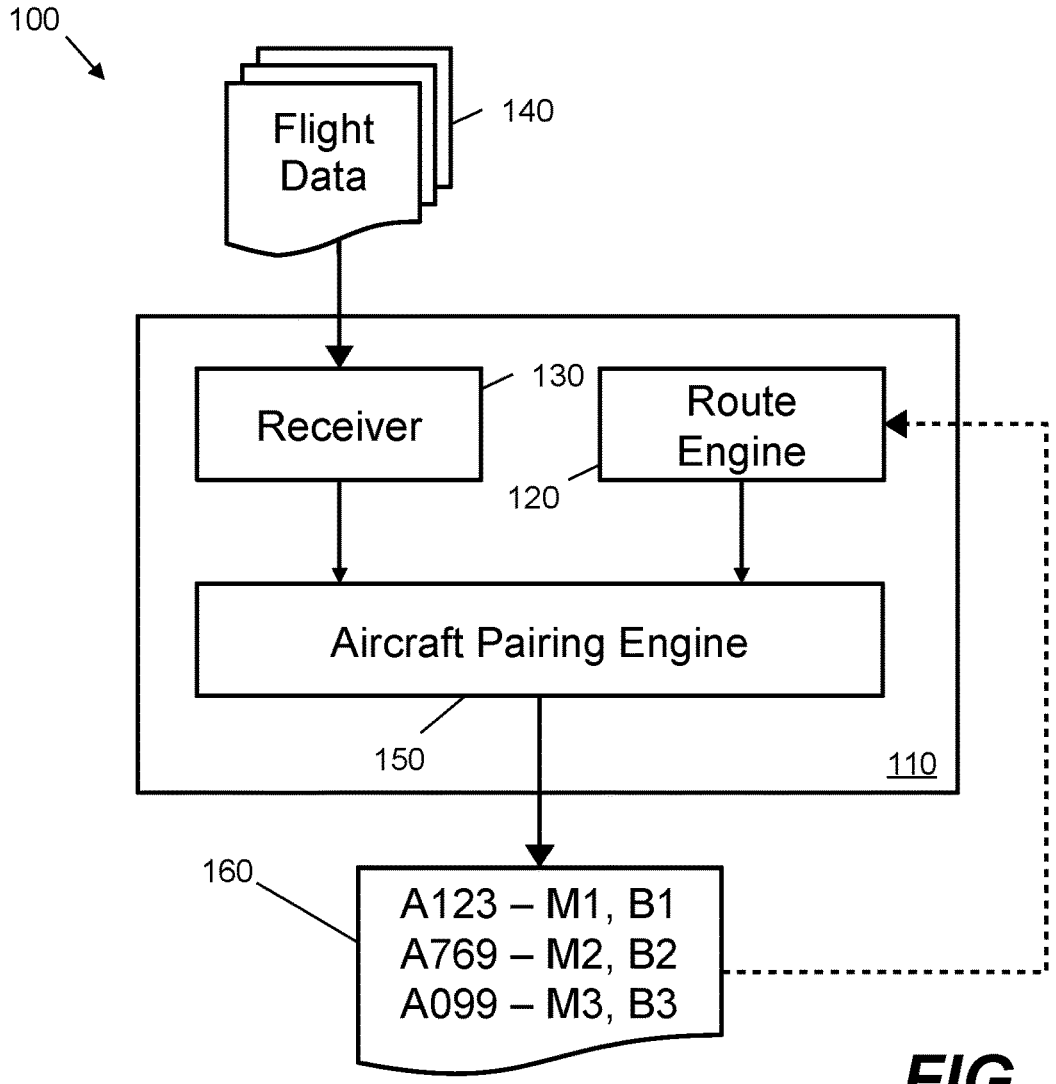
FIG. 1 shows a schematic representation of an on-board computing apparatus for an aircraft according to an example.

FIG. 1 shows an example 100 of an on-board computing apparatus 110 for an aircraft. The on-board computing apparatus 110 may form part of a flight control system such as a Flight Management System for an aircraft or an Electronic Flight Bag. An Electronic Flight Bag is an electronic information management device for use by flight crews in performing flight tasks. The on-board computing apparatus 110 may be implemented by way of computer program code in combination with processing devices and/or dedicated control circuitry, such as application specific integrated circuits or system-on-chip devices. The aircraft in which the on-board computing apparatus 110 operates is referred to in the present example as a "primary aircraft". The on-board computing apparatus 110 may operate, independently or in combination with pilot input, to control the flight of the primary aircraft. The on-board computing apparatus 110 is adapted to pair the primary aircraft with one or more of a plurality of secondary aircraft. This pairing is spatio-temporal, i.e. is a pairing of aircraft in space and time. The on-board computing apparatus 110 may pair the primary aircraft with a "best match" in space and time, e.g. with one or more secondary aircraft that maximise an overlap in space and time. Overlap in this sense means that the primary aircraft, during a time of flight, maintains a spatial distance from a selected secondary aircraft for a period of time that is within a distance threshold, e.g. in two- or three-dimensional space.

The on-board computing apparatus 110 of FIG. 1 comprises a route engine 120, a receiver 130 and an aircraft pairing engine 150. The route engine 120 provides aircraft data for a route flown by the primary aircraft. The route engine 120 may comprise a dedicated flight control device that monitors flight parameters such as speed, altitude, location and the like. The route engine 120 may be coupled to measurement devices such as one or more air-speed measurement devices on an aircraft body, a positioning system such as a Global Positioning System (GPS) device that provides at least a latitude and a longitude of the primary aircraft, and an altimeter that provides at least an altitude of the aircraft. The route engine 120 may also comprise, or be coupled to and receive data from, flight planning devices that comprise a storage medium to store a predefined indication of desired position and/or altitude over a time period representing a flight time of the primary aircraft. The route engine 120 may process flight measurements to provide data in a normalized or canonical form. In one case, the route engine 120 is arranged to output aircraft data in the form of one or more: of a flight plan for the primary aircraft; an altitude profile for the primary aircraft; and a speed profile for the primary aircraft. A profile may comprise a set of values over a predefined time period. These values may comprise a combination of measured values, e.g. for a period in the past, and predicted or planned values, e.g. for a period in the future, as compared to a given current time. The route engine 120 may be configured to supply this data directly, e.g. in response to a command or request received over a systems bus, and/or may provide this data within a shared memory that is accessible by other components of the on-board computing apparatus 110.

The receiver 130 of the on-board computing apparatus 110 in FIG. 1 receives aircraft data 140 for a plurality of secondary aircraft. The receiver 130 may receive the aircraft data 140 over a secure over-the-air communications channel. The receiver 130 may comprise components to implement one or more layers of a communications protocol stack. The receiver 130 may receive aircraft data 140 from each of the plurality of secondary aircraft, e.g. over a peer-to-peer communications network that is configured during flight of the primary and secondary aircraft. The receiver 130 may additionally and/or alternatively receive the aircraft data 140 from one or more ground stations, such as air traffic control towers and the like. In one case, a ground station may collate aircraft data for a plurality of aircraft within a given geographic range, e.g. X miles from the ground station, and provide this to the receiver 130 of the primary aircraft, e.g. using a communications channel on a given frequency or frequency range. The communications channel used by the receiver 130 may be encrypted for security. The receiver 130 may be arranged to decrypt received aircraft data and/or receive decrypted aircraft data from an independent cryptographic component. The receiver 130 may be arranged to receive and/or process the aircraft data 140 such that it may be supplied to further components in a similar form to the aircraft data provided for the primary aircraft by the route engine 120. For example, the receiver 130 may be arranged to output aircraft data comprising one or more of: a flight plan for a given secondary aircraft; an altitude profile for the given secondary aircraft; and a speed profile for the given secondary aircraft. As before, a profile may comprise a set of values over a predefined time period. These values may comprise a combination of measured values, e.g. for a period in the past, and predicted or planned values, e.g. for a period in the future, as compared to a time of transmission. The receiver 130 may be configured to supply aircraft data directly, e.g. in response to a command or request received over a systems bus, and/or may provide this data within a shared memory that is accessible by other components of the on-board computing apparatus 110.

In the example of FIG. 1, both the route engine 120 and the receiver 130 provide aircraft data to the aircraft pairing engine 150. The aircraft pairing engine 150 is configured to pair the primary aircraft with a secondary aircraft from the plurality of secondary aircraft based on aircraft data from the route engine 120 and aircraft data from the receiver 130. The aircraft pairing engine 150 comprises electronic circuitry, e.g. in the form of a processing device arranged to execute instructions loaded into memory from a data storage device or in the form of an embedded micro-controller. It should be understood that dedicated circuitry may be faster and/or more secure than a general processing device, but may require replacement to upgrade functionality, as opposed to changing a firmware instruction set. An appropriate trade-off may be selected based on the implementation.

The aircraft pairing engine 150 is configured to determine a set of candidate aircraft from the plurality of secondary aircraft based on a route similarity metric. The route similarity metric comprises a function of the aircraft data for the primary aircraft and the aircraft data for a secondary aircraft and indicates a similarity of a route flown by one of the plurality of secondary aircraft to the route flown by the primary aircraft. For example, the route similarity metric may be computed by applying a sequence of operations to data values present in the two sets of aircraft data. A route similarity metric may be computed for a plurality of pairings, e.g. for each pair consisting of the primary aircraft and a secondary aircraft from the plurality of secondary aircraft. The route similarity metric may apply a plurality of constraints, and indicate whether a route for a given secondary aircraft meets the plurality of constraints. In one case, the route similarity metric may comprise a variable indicating whether a route for a given secondary aircraft meets the plurality of constraints. Computation of the route similarity metric may include: a comparison of an altitude of the primary aircraft with an altitude of a given secondary aircraft; a comparison of an aircraft type of the primary aircraft with an aircraft type of the given secondary aircraft; and a comparison of top-of-climb and top-of-descent times for a cruise trajectory of the primary aircraft with corresponding required times of arrival at points on a cruise trajectory of the given secondary aircraft. These may be required times of arrival that are within a predefined threshold of the top-of-climb time and the top-of-descent time for the primary aircraft. In certain cases, these may be a top-of-climb time and a top-of-descent time for the secondary aircraft. A comparison of altitude values may comprise comparing average altitudes for a cruise trajectory. In certain cases, a cruise trajectory may be defined as a set of locations and corresponding times. A cruise trajectory may be defined using at least two points in space, each point having an associated time of arrival. These two points may indicate a location for a top-of-climb sequence and a location for a top-of-descent sequence. A cruise trajectory may be defined as a route in a given plane above the surface of the earth having an altitude. The comparison of altitudes and/or times may comprise determining if a magnitude of a difference between values lies within a predefined threshold. A comparison of aircraft types may comprise determining whether the secondary aircraft has an aircraft type that is compatible with the primary aircraft for formation flying. For example, the on-board computing apparatus 110 may store data indicating a set of compatible aircraft types for one or more aircraft types.

The aircraft pairing engine 150 is also configured to process flight times for cruise trajectories of the primary aircraft and the set of candidate aircraft determined from the aircraft data from the route engine 120 and the aircraft data from the receiver 130 to output data in the form of route portions 160 for a subset of the set of candidate aircraft. Each route portion 160 comprises a definition of at least a portion of a route of a secondary aircraft that is deemed to overlap with the route for the primary aircraft. Each route portion may be defined by an aircraft identifier (e.g. "A123", "A769" and "A099" in FIG. 1) that identifies a given secondary aircraft, a merge point ("Mx") that indicates at least a time that the route portion starts an overlap with the route for the primary aircraft, and a break point ("Bx") that indicates at least a time that the route portion ends an overlap with the route for the primary aircraft. There may be one or more route portions if an overlap is possible. If an overlap is not possible, this may be indicated by the aircraft pairing engine 150 and no route portions may be output.

The route portions 160 output by the aircraft pairing engine 150 may be used in a number of different ways. In one implementation, they may be presented to a pilot or navigator of the primary aircraft. In another implementation, as well as or instead of this presentation, the route portions 160 may be used to adjust a route flown by one or more of the primary aircraft and an indicated secondary aircraft. As indicated by the dotted line in FIG. 1, in certain cases the route engine 120 is to receive the output of the aircraft pairing engine 150 and adjust the route flown by the primary aircraft to fly in formation with one or more of the subset of the set of candidate aircraft. For example, one or more of a flight plan, a speed profile and an altitude profile may be adjusted to introduce a predefined separation between the primary aircraft and the secondary aircraft, e.g. such that one of the aircraft may take advantage of a vortex created by the other of the aircraft. The predefined separation may be a predefined "safe" separation in two- or three-dimensional space. In one case, an altitude may be adjusted to bring the two aircraft into alignment in a flight plane. In another case, a speed may be adjusted such that, for a period of time, the two aircraft maintain a relative velocity below a predefined threshold. The route portions 160 may be used to make an adjustment via a flight control system of the primary aircraft, or via a flight control system of the secondary aircraft, or via both flight control systems.

Figure 2:
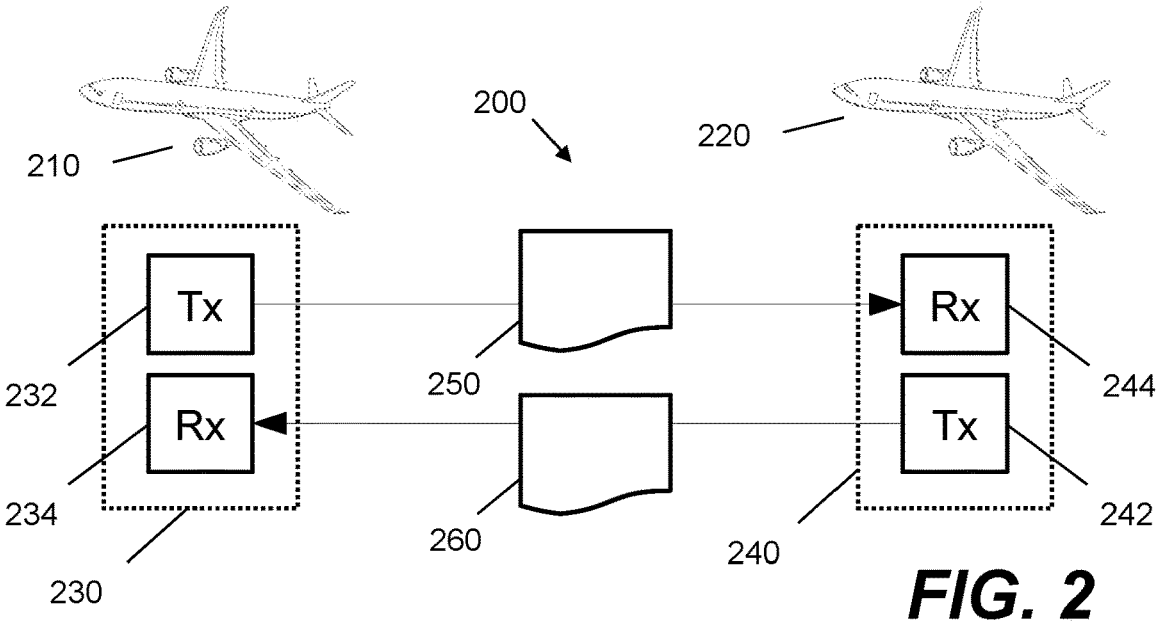
FIG. 2 shows a schematic representation of a communication system for exchanging data between two aircraft according to an example.

FIG. 2 shows an example 200 of communication between a primary aircraft 210 and a secondary aircraft 220 so as to fly in formation based on an output of the aircraft pairing engine 150. The primary aircraft 210 comprises a first on-board computing apparatus 230 and the secondary aircraft 220 comprises a second on-board computing apparatus 240. The two on-board computing apparatus 230, 240 may be of a common construction, and may comprise the on-board computing apparatus 110 of FIG. 1. The first on-board computing apparatus 230 comprises a transmitter 232 and a receiver 234. The second on-board computing apparatus 240 also comprises a transmitter 242 and a receiver 244. The receivers 234, 244 may comprise a receiver such as receiver 130 of FIG. 1. In certain cases, the transmitters and receivers may be combined in each on-board computing apparatus to form a transceiver. In use, the transmitter 232 of the first on-board computing apparatus 230 transmits data 250 to the receiver 244 of second on-board computing apparatus 240. Similarly, in FIG. 2, the receiver 234 of the first on-board computing apparatus 230 receives data 260 transmitted by the transmitter 242 of second on-board computing apparatus 240. The data 250 may initially comprise aircraft data for the primary aircraft 210 and the data 260 may initially comprise aircraft data for the secondary aircraft 220. The data 250, 260 may initially comprise data output by a route engine such as route engine 120 that forms part of each on-board computing apparatus 230, 240. In one case, only aircraft data for the secondary aircraft 220 may be transmitted and received.

The first on-board computing apparatus 230 may be configured to output data indicating shared route portions as per the example of FIG. 1. If a route portion identifies the secondary aircraft 220, e.g. indicates that a route portion for the secondary aircraft is a "best-match" for the route flown by the primary aircraft 210, then the first on-board computing apparatus 230 may transmit, via transmitter 232, data 250 in the form of an indication of route sharing to the secondary aircraft 220, i.e. where the secondary aircraft is one of the subset of the set of candidate aircraft. The secondary aircraft 220 may be identified by way of an aircraft identifier, e.g. as received with initial data 260. Following receipt of the indication of route sharing by the receiver 244 of the second on-board computing apparatus 240, the secondary aircraft 220 may adjust its aircraft data to provide formation flying with the primary aircraft 210. This adjustment may be indicated by transmitting updated aircraft data 260 to the receiver 234 of the first on-board computing apparatus 230. In this manner, co-ordination of formation flying may be achieved without a need for centralised ground control.

In certain cases, the aircraft pairing engine 150 of FIG. 1 comprises a paired-route adjustment engine to select a route portion associated with one of the subset of the set of candidate aircraft and to determine, in conjunction with aircraft data supplied by the route engine 120, a route adjustment to one or more of the route flown by the primary aircraft and the selected route portion to maintain a predetermined flight separation, for the time of the route portion, between the primary aircraft and the one of the subset of the set of candidate aircraft. This route adjustment may comprise an adjustment to be made by the secondary aircraft that is transmitted to the secondary aircraft 240 using the example 200 of FIG. 2. For example, a route adjustment may comprise a change in speed to be applied by both the primary aircraft 210 and the secondary aircraft 220, and/or a change in a flight plan for one or more aircraft.

In certain examples, the receiver 130 and the aircraft pairing engine 150 of FIG. 1 are activated iteratively during flight of the primary aircraft to output updated route portions 160 for a subset of the secondary aircraft that represent changes in one or more of the aircraft data of the primary aircraft and the aircraft data of the secondary aircraft. For example, the primary aircraft 210 and the secondary aircraft 220 may continuously and/or periodically exchange data 250, 260 over a peer-to-peer in-flight communications network. This data may indicate changes in aircraft data for one or more of the primary aircraft 210 and the secondary aircraft 220. These changes may be due to, amongst others, changes initiated by a pilot, changes instructed by air traffic control, changes due to aircraft performance, changes due to weather conditions, and/or changes due to other environmental or human factors. Using the described examples, the aircraft pairing engine 150 may determine whether a pairing still holds given the change in conditions, and/or whether a new pairing is more suitable. As such, the examples are able to provide dynamic pairings for formation flying. Even though, for ease of explanation, the example of FIG. 2 has been described in relation to a single secondary aircraft, in practice the exchanges described with reference to FIG. 2 may be performed in parallel for a plurality of secondary aircraft. The examples described herein are able to scale with such a scenario, and to iteratively select "best" pairings of aircraft from a changing dynamic set of secondary aircraft. In certain cases, data may be shared in real-time or near real-time and thus allow for collaborative flight management during flight.

Figure 3A:
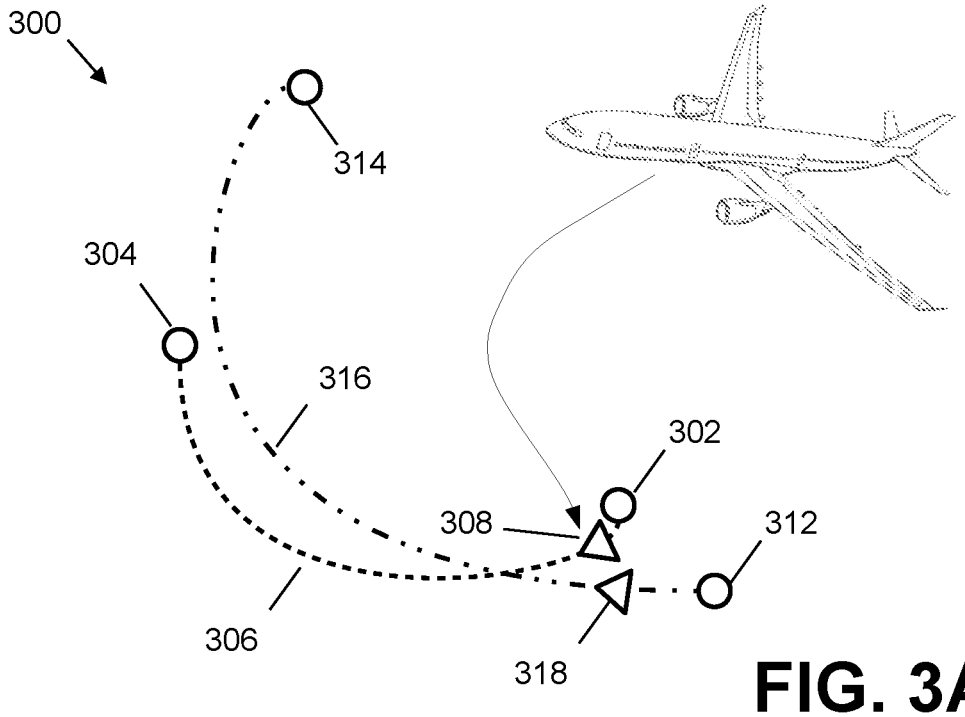
FIGS. 3A to 3D show schematic representations of aircraft routes as implemented according to an example.

FIGS. 3A to 3D show two simplified examples of an application of the examples described herein, such as an application of the on-board computing apparatus 110 of FIG. 1. FIG. 3A shows an example 300 of two cruise trajectories for two aircraft. For simplicity, these cruise trajectories are shown in a two-dimensional plane, although they may be defined in three-dimensions. Further, each cruise trajectory will take place in time, and so the cruise trajectories are defined in both space and time. A first cruise trajectory, also referred to as a cruise phase, has a top-of-climb point 302 and time, and a top-of-descent point 304 and time. The term "top-of-climb" refers to the end of a period of flight where the aircraft climbs, e.g. from ground level at take-off, to a cruising altitude. It marks the start of a cruise trajectory. The term "top-of-descent" refers to the start of a period of flight where the aircraft descends from the cruising altitude, e.g. to a ground level for landing. In some cases, an aircraft may have a number of cruise trajectories relating to different periods of flight, e.g. at different altitudes. A flight route 306 for the cruise trajectory is a defined path through airspace from the top-of-climb time to the top-of-descent time for a first aircraft 308. The flight route 306 may be defined geometrically and/or by a series of points in space and time. For example, a flight route 306 may be a defined curve between the top-of-climb point 302 and the top-of-descent point 304 and/or a series of points connected by curves and/or straight lines. The flight route 306 may form a part of a flight plan. The flight route 306 may have a corresponding altitude or series of altitudes, which may form part of an altitude profile. Likewise, the first aircraft 308 may have a velocity or series of velocities along the flight route 306, which may form part of a speed profile. Similarly, a second cruise trajectory is shown in FIG. 3A. This has a top-of-climb point 312 and time, and a top-of-descent point 314 and time. A flight route 316 extends between these two points, which is flown, in time, by a second aircraft 318.

Figure 3B:
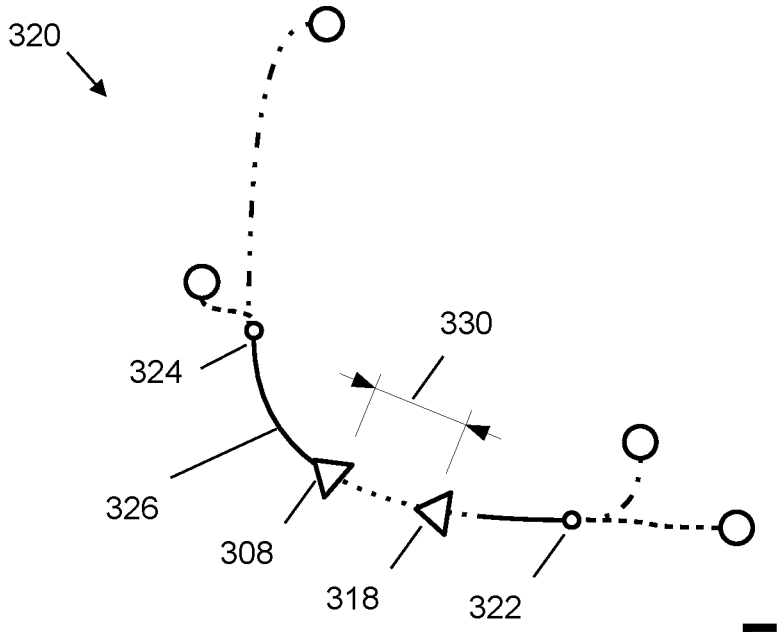

Based on the aircraft data visualised in FIG. 3A, examples described herein may output an indication that the first aircraft 308 and the second aircraft 318 may be paired for formation flying. For example, an on-board computing apparatus such as on-board computing apparatus 150 in FIG. 1, used on the first aircraft 308, may indicate that a shared route portion is possible. The flight routes 306 and 316 may then be adjusted such that the first aircraft 308 and the second aircraft 318 fly in formation with a predefined separation for the shared route portion. This is illustrated in the example 320 of FIG. 3B. FIG. 3B shows that a merge point 322 and a break point 324 have been defined. These represent points in time when formation flying may start and end. Between the merge point 322 and the break point 324, the first and second aircraft 308, 318 share a common route with a custom separation distance 330 between the aircraft. The separation distance 330 may be enforced in time, e.g. the first aircraft 308 may be controlled to fly the common route 326 at a first time, and the second aircraft 318 may be controlled to fly the common route 326 at a second time, wherein the second time is a predetermined period after the first time so as to maintain a separation in two- or three-dimensional space. In the example of FIG. 3B, the first aircraft 308 is a lead aircraft and the second aircraft 318 is a follower aircraft. The choice of lead and follower roles may be decided based on the aircraft data for the aircraft, such as times of arrival at points in space.

Figure 3C:
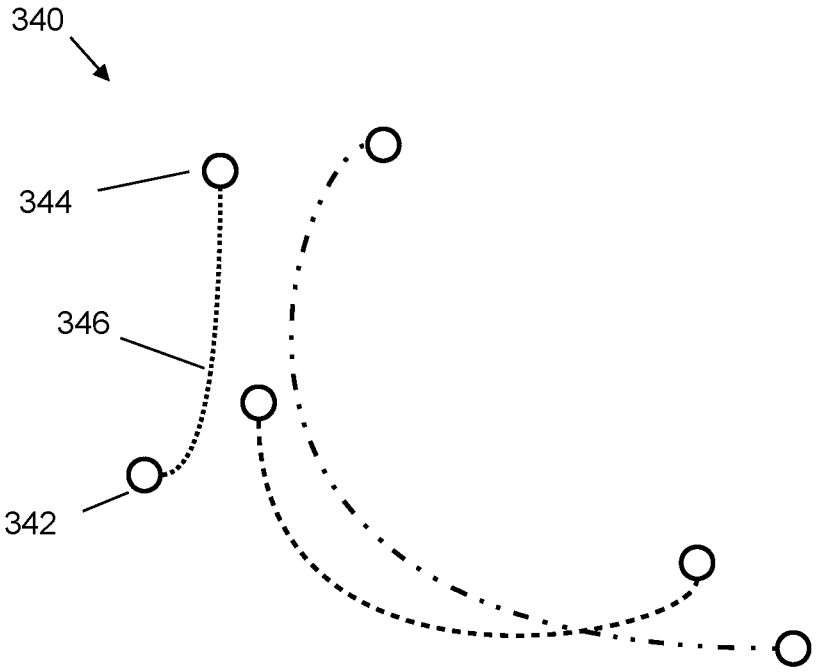
Figure 3D:
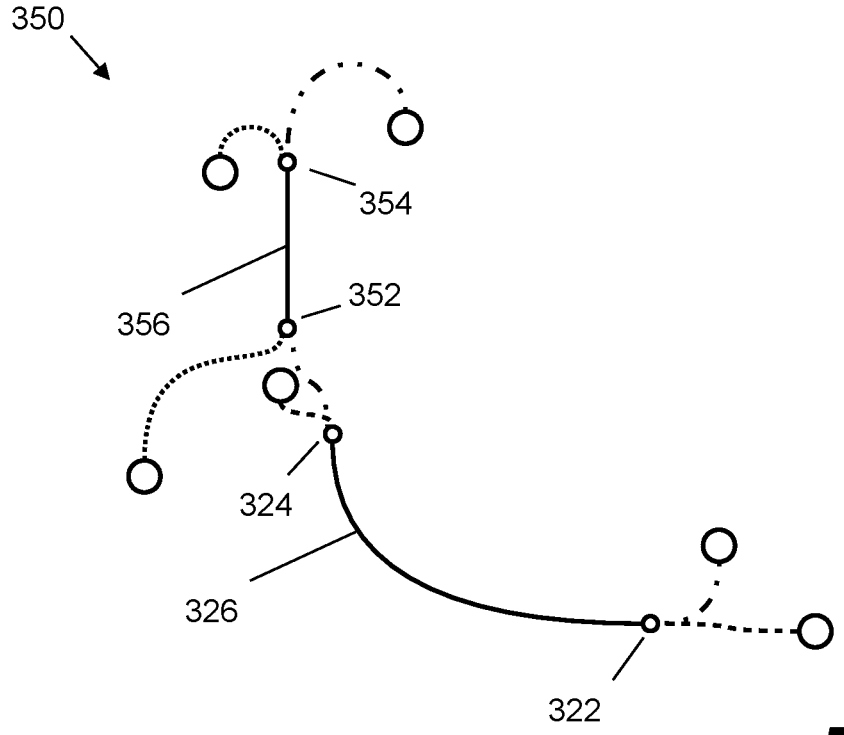

FIGS. 3C and 3D show an extension of the example of FIGS. 3A and 3B to a case where there are multiple shared route portions. Although FIGS. 3A to 3D only show a limited number of aircraft, in practice there may be many aircraft with cruise trajectories within a particular volume of airspace. It should also be noted that, for at least some aircraft, a suitable pairing may not be possible, e.g. as indicated by the formation of the candidate set of secondary aircraft by the aircraft pairing engine 150 of FIG. 1.

FIG. 3C shows an example 340 of an additional cruise trajectory for a third aircraft. Again, the cruise trajectory comprise a top-of-climb point 342 and time and a top-of-descent point 344 and time, the points 342, 344 being connected with a flight route 346.

FIG. 3D shows how the second aircraft may share a route portion with the first aircraft and also share a route portion with the third aircraft. For example, a first shared route portion 326 between a first merge point 322 (M1) and a first break point 324 (B1) may allow formation flying for the first and second aircraft. A second shared route portion 356 may also be defined between a second merge point 352 (M2) and a second break point 354 (B2). This may allow formation flying for the second aircraft and the third aircraft.

The examples of FIG. 3A to 3D show how shared route portions may be used. In practice, there may be many flight routes defined for many different aircraft. The examples described herein provide a practical solution to manage this complexity, wherein the examples are able to scale and accommodate real-time implementation and iteration.

In one case, the aircraft pairing engine 150 of FIG. 1 comprises electronic circuitry to perform a number of operations to process flight times. These operations may involve a first operation of sorting the cruise trajectories of the set of candidate aircraft based on required times of arrival in the aircraft data from the receiver that are associated with the top-of-descent time of the primary aircraft to generate a list of sorted cruise trajectories. For example, cruise trajectories may be sorted to have increasing required times of arrival. The required times of arrival may initial be times of arrival along a route of the secondary aircraft that are within a threshold of the top-of-descent time of the primary aircraft. Following the sorting operation, an iterative processing operation may be performed. In this case, the aircraft pairing engine 150 may iteratively process earliest and latest cruise trajectories in the list of sorted cruise trajectories to add route portions computed from the list of cruise trajectories to a list of output route portions based on a maximized time of flight. For example, the aircraft pairing engine 150 may select cruise trajectories that have a first required time of arrival (RTA) that is within a predefined threshold of the top-of-climb time for the primary aircraft (e.g. T1 in the example of FIGS. 3A and 3B). The required time of arrival may indicate an arrival time at a point along a route of the secondary aircraft. In certain cases, the first required time of arrival may be a time at which the secondary aircraft reaches a top-of-climb point; in other cases, the first required time of arrival may be a time of arrival at another point along a cruise trajectory of the secondary aircraft. Of these selected cruise trajectories, a first route portion may be selected as the cruise trajectory with the maximum time between the first required time of arrival and a required time of arrival that is associated with the top-of-decent time of the primary aircraft. For example, this second required time of arrival may be a time at which the secondary aircraft reaches a top-of-descent point or a time of arrival at another point along a cruise trajectory of the secondary aircraft, e.g. a required time of arrival at a point that is within a predefined threshold of the top-of-descent point for the primary aircraft. These required times of arrival may be modified during the aircraft pairing as described below. A similar process may then be applied based on the second required time of arrival. For example, the aircraft pairing engine 150 may select cruise trajectories that have a second required time of arrival that is within a predefined threshold of the top-of-descent time for the primary aircraft (e.g. T2 in the example of FIGS. 3A and 3B). Of these selected cruise trajectories, a second route portion may be selected as the cruise trajectory with the maximum time between the first and second required times of arrival. Additional route portions may then be selected by truncating time entries in the list of cruise trajectories based on the selected route portions, e.g. such that only an unpaired portion of the route of the primary aircraft is considered. The process may then be repeated with these truncated entries, e.g. repeated for the unpaired portion of the route of the primary aircraft.

Figure 4:
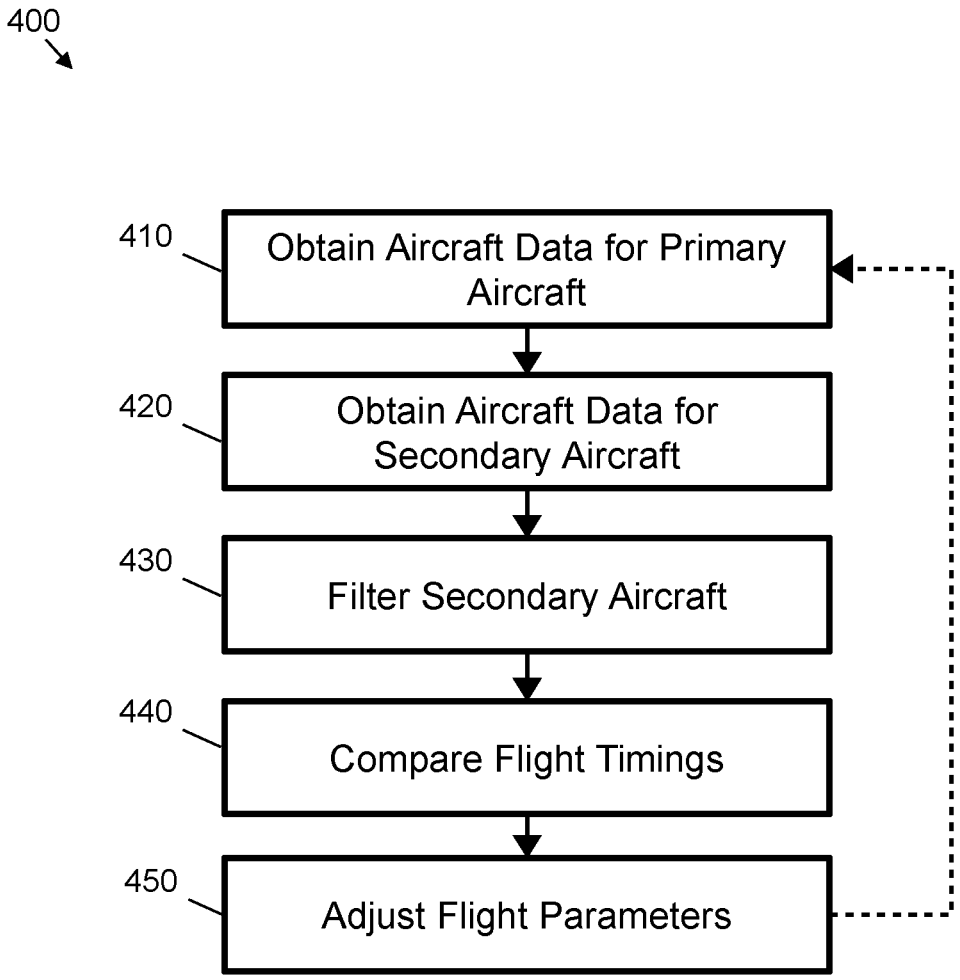
FIG. 4 shows a flow chart of a control process for an aircraft according to an example.

FIG. 4 shows a method 400 of controlling a primary aircraft. This method may be performed by an on-board computing apparatus, such as on-board computing apparatus 110 of FIG. 1, or may be performed by an alternative device, such as a computing device based in a ground control station or other flight processing location. The method 400 may be implemented by way of computer program code that is executed on a processing device.

At block 410, aircraft data for the primary aircraft is obtained. For example, this may be obtained directly or indirectly from a component such as route engine 120 in FIG. 1. It may comprise aircraft data that is transmitted from the primary aircraft in flight, or may comprise proposed aircraft data for a future flight. At block 420, aircraft data for a set of secondary aircraft is obtained. This may be obtained in a similar or different manner to the aircraft data for the primary aircraft. For example, it may be received from a plurality of on-board computing devices via one or more over-the-air transmissions, and/or it may be retrieved from a data storage device. In one case, obtaining comprises accessing data that is stored in memory, e.g. that has been loaded from a data storage medium.

At block 430, the set of secondary aircraft are filtered based on a constrained comparison of kinematics for the primary aircraft and the set of secondary aircraft derived from the aircraft data. This may be seen as a type of pre-processing. Kinematics for the primary aircraft and the set of secondary aircraft may comprise data indicating movement, whether planned or actual, of the aircraft through space over time. The comparison may comprise a comparison of one or more of points in space and time. The comparison is said to be constrained as a particular secondary aircraft may be excluded from a set of filtered secondary aircraft (so-called "candidate aircraft") if a value resulting from a comparison, e.g. a difference or difference metric, falls outside of a predefined range, e.g. is not within a threshold value. The comparison may also be said to be constrained as other constraints may be applied to a given secondary aircraft, e.g. a test for aircraft compatibility may be performed. For example, aircraft may be able to take part in formation flying if they are of a similar size, with a similar propulsion system, e.g. they may need to be within a defined set of compatible aircraft models or types. This block may, for example, be performed by the aircraft pairing engine 150 of FIG. 1.

At block 440, flight timings for the filtered set of secondary aircraft are compared to flight timings for the primary aircraft to output a set of paired route portions for a subset of the filtered set of secondary aircraft. The paired route portions indicate a potential overlap with a flight route for the primary aircraft. The flight timings may comprise times for arrival at spatial locations, such as points associated with a top-of-climb and a top-of-descent as described with reference to the examples of FIGS. 3A to 3D. As discussed previously, these times may comprise the start and end of a cruise phase and/or required times of arrival for the secondary aircraft that are within a predefined threshold period as compared to the top-of-climb and top-of-descent times of the primary aircraft. Block 440 may comprise identifying at least portions of a cruise trajectory that maximise a time that a flight route of a secondary aircraft is within specified bounds of a flight route of the primary aircraft. These bounds may comprise being within an average spatial distance. Block 440 may, for example, be performed by the aircraft pairing engine 150 of FIG. 1.

At block 450, flight parameters are adjusted so as to maintain at least a predefined separation between the primary aircraft and the secondary aircraft for the one or more paired route portions, i.e. the paired route portions determined at block 440. Block 450 may be repeated for each paired route portion in the set of paired route portions, e.g. to allow formation flying such as is illustrated in FIG. 3D. The flight parameters may comprise one or more of: a flight plan, a speed profile and an altitude profile. The flight parameters may be adjusted automatically or manually. In one case, block 450 may comprise outputting revised aircraft data for one or more of the primary aircraft and selected secondary aircraft, wherein the revised aircraft data indicate formation flying with the predefined separation. Block 450 may comprise generating output data as visualised in FIGS. 3B and 3D, e.g. based on input data as shown in FIGS. 3A and 3C.

The method 400 may be repeated during movement of the primary aircraft along the flight route for the primary aircraft. For example, the method 400 may be performed a first time before flight to determine a flight route that involves formation flying for one or more paired route portions. During flight, the method 400 may be performed on-board the primary aircraft to update the paired route portions based on any changes that have occurred since the first time.

In one case, filtering the set of secondary aircraft at block 440 comprises, for a given secondary aircraft, determining whether one or more of the following constraints are met: that an altitude of the given secondary aircraft is within a threshold distance of an altitude of the primary aircraft; that within a plane of flight, a flight route for the given secondary aircraft is within a threshold distance of a flight route for the primary aircraft; that an aircraft type of the given secondary aircraft is compatible with an aircraft type of the primary aircraft; and that required times of arrival for the secondary aircraft are within a range between a top-of-climb time and a top-of-descent time for the primary aircraft.

In one case, comparing flight timings at block 440 comprises: obtaining, from the aircraft data for the primary aircraft, data indicating a top-of-climb time and a top-of-descent time for the primary aircraft; obtaining, from the aircraft data for the secondary aircraft, data indicating required times of arrival for each of the secondary aircraft that are associated with the top-of-climb time and the top-of-descent time of the primary aircraft (e.g. that are within a predefined threshold of these times); ordering the data for the secondary aircraft based on a second require time of arrival that is associated the top-of-climb time for the primary aircraft; and iteratively selecting route portions from the ordered data for the filtered set of secondary aircraft by maximising time periods between merge and break-away points, the merge and break-away points comprising points in time where a route portion for a secondary aircraft overlaps with the flight route for the primary aircraft. More detail of an example implementation of block 440 is described with reference to FIG. 5 below.

Figure 5:
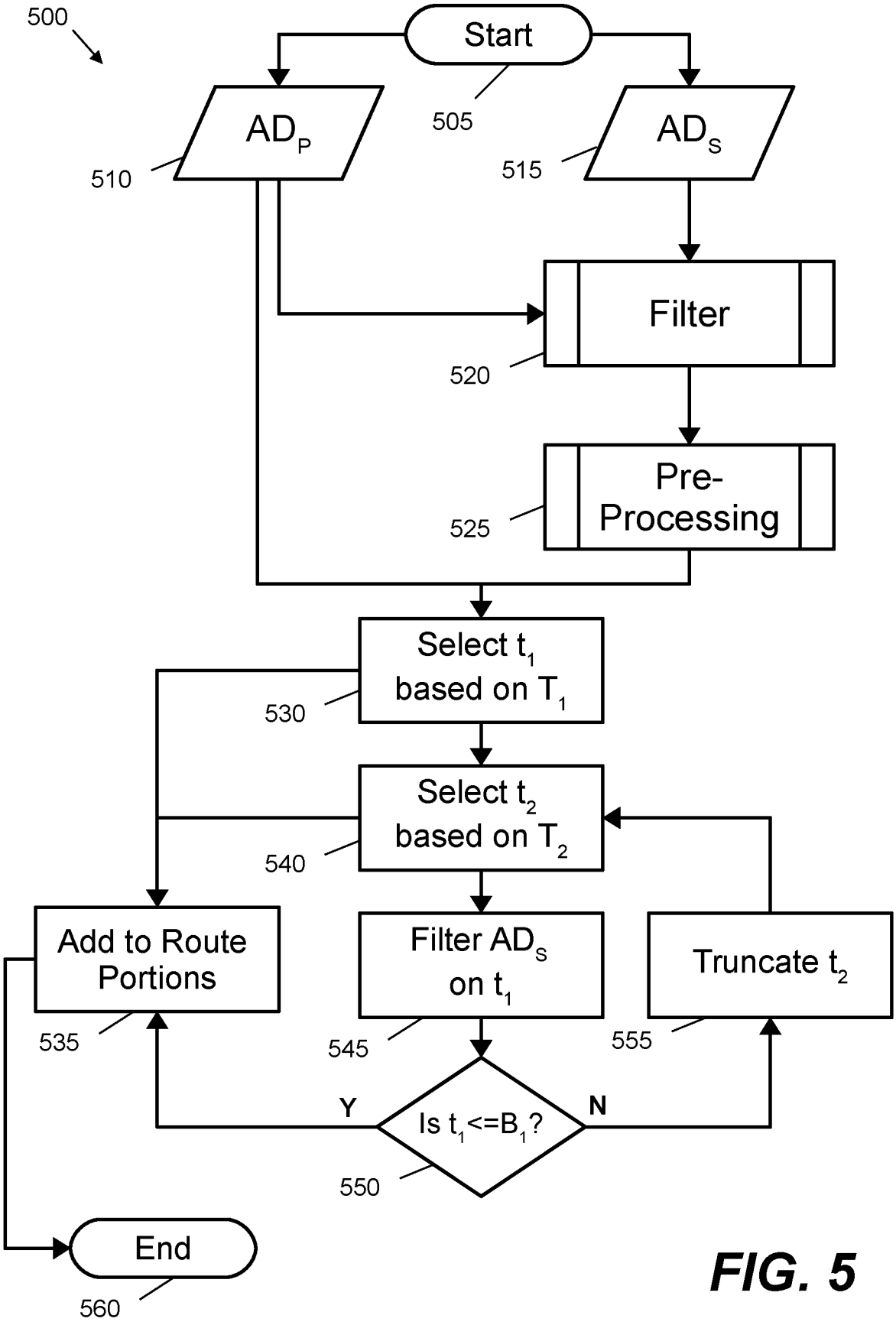
FIG. 5 shows a flow chart of a process for pairing aircraft according to an example.

FIG. 5 shows a method 500 of pairing aircraft according to an example. The method 500 may be used in a particular implementation of the method 400 or the on-board computing apparatus 110 of FIG. 1.

The method starts at block 505. At block 510, aircraft data for a primary aircraft $AD_P$ is gathered. The primary aircraft may be an aircraft that is performing the method 500. Aircraft data $AD_P$ may comprise a flight plan for the primary aircraft, an altitude profile for the primary aircraft, a speed profile for the primary aircraft, a top-of-climb time (T1) and a top-of-descent time (T2). As described previously, $AD_P$ may be supplied by a component of the primary aircraft such as route engine 120 in FIG. 1. At block 515, aircraft data for a plurality of secondary aircraft $AD_S$ is gathered. The secondary aircraft may be aircraft that are local to the primary aircraft in airspace, e.g. aircraft within a predefined reception radius. Aircraft data $AD_S$ may comprise a list of aircraft data entries, where each entry is associated with an identified secondary aircraft, e.g. by way of an aircraft identifier. In addition to an aircraft identifier, each entry may further comprise a flight plan for the given secondary aircraft, an altitude profile for the given secondary aircraft, a speed profile for the given secondary aircraft, a top-of-climb time and a top-of-descent time. Blocks 510 and 515 may comprise determining a cruise trajectory and/or phase from received aircraft data, e.g. determining the top-of-climb times and a top-of-descent times from route data, the altitude profile and/or the speed profile.

At block 520, the aircraft data for the plurality of secondary aircraft $AD_S$ is filtered. As indicated by the arrow from block 510, the filtering of the aircraft data $AD_S$ may be performed with reference to values of the aircraft data $AD_P$. The filtering at block 520 may be performed to determine a candidate set of secondary aircraft, e.g. a set of secondary aircraft that are initially suitable and/or eligible for pairing given one or more applied constraints. At block 520, a number of constraints may be applied, wherein secondary aircraft that meet the constraints are filtered into the candidate set of secondary aircraft. The constraints may include: determining whether an altitude of the secondary aircraft is within a predefined range centred around the altitude of the primary aircraft; determining whether a cruise trajectory of the secondary aircraft has an overlap with a cruise trajectory of the primary aircraft, e.g. within a predefined range or threshold ΔD; determining whether the secondary aircraft is of a type that is compatible with the primary aircraft; and/or determining whether one or more of the required times of arrival for the secondary aircraft fall within a range set by the top-of-climb time (T1) and a top-of-descent time (T2) for the primary aircraft. In one case, all of the aforementioned constraints may be applied to filter the secondary aircraft.

Blocks 525 to 555 represent a particular method to determine a "best pair" of aircraft, where the "best pair" is determined in terms of a maximum overlap of a flight route between the aircraft. Blocks 525 to 555 may be seen to apply a "best first" or "greedy" search over the filtered list of aircraft data for the secondary aircraft. The particular method of FIG. 5 applies an approach that may be implemented rapidly within resource-constrained on-board hardware, while still allowing "good" pairs to be matched. The approach finds matches quickly, and so is suitable for real-time implementations, even though the located pairs may not necessarily be optimal in the entire search space represented by aircraft data $AD_S$. In the approach, stages such as block 520 reduce a size of a search space to better enable a match to be located.

At block 525, pre-processing is applied to the aircraft data for the candidate set of secondary aircraft that resulted from the filtering at block 520. Pre-processing may comprise one or more of the following operations: selecting route data relevant to a cruise phase between a first required time of arrival (t1) and a second required time of arrival (t2) for the secondary aircraft, wherein the first required time of arrival is within a first predefined threshold of the top-of-climb time for the primary aircraft and the second required time of arrival is within a second predefined threshold of the top-of-descent time for the primary aircraft; sorting the aircraft data such that entries are listed in an order of increasing second required times of arrival (t2); truncating parts of a cruise trajectory that occur before the top-of-climb time (T1) for the primary aircraft and that occur after the top-of-descent time (T2); removing or deleting entries that have short cruise trajectories, e.g. where the cruise trajectory has a distance or length d that is less than a predefined threshold Δd (i.e. deleting entries where $d<\Delta d$); and marking or filtering duplicate routes. Truncating times may comprise setting first required times of arrival (t1) that are less than the top-of-climb time (T1) for the primary aircraft to the top-of-climb time (T1) for the primary aircraft (e.g. t1=T1 if t1<T1) and setting second required times of arrival (t2) that are greater than the top-of-descent time (T2) for the primary aircraft to the top-of-descent time (T2) for the primary aircraft (e.g. t2=T2 if t2>T2). Marking or filtering duplicate routes may comprise selecting one out of a set of duplicate routes to retain in the filtered aircraft data.

At block 530, a set of cruise trajectories from the filtered and pre-processed aircraft data $AD_S$ is selected based on a comparison of their first required times of arrival (t1) to the top-of-climb time (T1) for the primary aircraft, e.g. as indicated or derived from aircraft data $AD_P$. This may be seen as processing cruise trajectories from a start of a filtered and pre-processed list of aircraft data entries. This may comprise selecting cruise trajectories with first required times of arrival (t1) that fall within a predefined range of the top-of-climb time (T1) for the primary aircraft and/or selecting a closest first required time of arrival (t1) to the top-of-climb time (T1) for the primary aircraft. At shown by the arrow to block 535 in FIG. 5, from the set of cruise trajectories identified at block 530, the cruise trajectory with the longest cruise time, t2–t1, may be selected as a first route portion. A first merge point M1 and a first break point B1 may thus be respectively set as the selected values for first required time of arrival (t1) and the second required time of arrival (t2).

At block 540, the remaining cruise trajectories are processed from the end of the list of aircraft data entries. At block 540, a set of cruise trajectories from the filtered and pre-processed aircraft data $AD_S$ is selected based on a comparison of their second required times of arrival (t2) to the top-of-descent time (T2) for the primary aircraft, e.g. as indicated or derived from aircraft data $AD_P$. This may comprise selecting cruise trajectories with second required times of arrival (t2) that fall within a predefined range of the top-of-descent time (T2) for the primary aircraft and/or selecting a closest second required time of arrival (t2) to the top-of-descent time (T2) for the primary aircraft. At shown by the arrow to block 535 in FIG. 5, from the (second) set of cruise trajectories identified at block 540, the cruise trajectory with the longest cruise time, t2–t1, may be selected as a second route portion. A second merge point M2 and a second break point B2 may thus be respectively set as the selected values for the first required time of arrival (t1) and the second required time of arrival (t2). The second route portion is added to the first route portion at block 535.

Blocks 540, 545, 550 and 555 may be repeated until a list of cruise trajectories has been exhausted, e.g. until all suitable cruise trajectories in the filtered and pre-processed aircraft data $AD_S$ have been processed. Blocks 540, 545, 550 and 555 involve filtering and modifying times for remaining cruise trajectories. At block 545, the remaining cruise trajectories in the filtered and pre-processed aircraft data $AD_S$ (e.g. initially the filtered set minus the trajectories selected for the first and second route portions), are further filtered to ignore any cruise trajectories with a first required time of arrival (t1) that is greater than the first required time of arrival for a last added route portion, i.e. M2 in the initial loop (e.g. ignore trajectories where t1>M2). At block 550, a check is made to determine if a last selected t1 value is less than or equal to the second required time of arrival for the first route portion (e.g. B1). The last selected t1 value comprises the t1 value corresponding to the cruise trajectory selected at block 540 (e.g. M2 on a first loop). If the condition at block 550 is met the method continues to block 535. If the condition is not met, e.g. $t_1$>B1, then the method continues to block 555. At block 555, the second required times of arrival for remaining cruise trajectories are truncated. This may comprise setting second required times of arrival in the list of remaining cruise trajectories to the first required time of arrival for the last selected route portion (e.g. on a first iteration t2=M2).

Following block 555, blocks 540, 545 and 550 are repeated until the condition applied at block 550 is met. In certain cases, if at block 550 a cruise trajectory remains and its current first required time of arrival is less than or equal to the second required time of arrival for the first route portion (e.g. B1) then the method may proceed to block 535 and a further route portion may be added where the merge-point Mx is set as the second required time of arrival for the first route portion (e.g. B1) and the break-point Bx is set as the current second required time of arrival (t2). At block 560, the method ends.

Blocks 530 to 555 and the method 500 may be understood by considering a simplified worked example. In this example, a primary aircraft has a top-of-climb time and a top-of-descent time as follows: T1=13:00, T2=17:00, which may be represented as a triple (P, 13:00, 17:00). Assume the times are provided based on Coordinated Universal Time (UTC). A candidate set of secondary aircraft, e.g. as resulting from block 520, may then comprise a list of triples of the form (aircraft_id, t1, t2), i.e. filtered $AD_S$=[(S1, 13:30, 14:40), (S2, 14:30, 16:00), (S3, 14:00, 16:00), (S4, 13:20, 15:45), (S5, 16:15, 17:00)]. At block 525, this set is sorted based on increasing t2 values: [(S1, 13:30, 14:40), (S4, 13:20, 15:45), (S2, 14:30, 16:00), (S3, 14:00, 16:00), (S5, 16:15, 17:00)]. At block 530, one or more trajectories from the set are selected based on a comparison of t1 and T1 values. In the present example, one or more cruise trajectories are selected with a t1 time that is closest to T1, i.e. (S4, 13:20, 15:45) is selected. In an alternative example, a threshold may be used, e.g. select all times where t1 is within 0:30 of T1, in which case (S1, 13:30, 14:40) and (S4, 13:20, 15:45) may be alternatively selected. If multiple trajectories are selected, e.g. as in the second alternative case, the trajectory with the longest period t2–t1 is selected, i.e. (S4, 13:20, 15:45). Route portions in this example may also be represented as triples—(aircraft_id, portion_no, M, B), where portion_no identifies the route portion, M is the merge point and B is the break point. The first route portion is thus added at block 535 as RP1=(S4, 1, 13:20, 15:45). Although not shown for ease of explanation, the merge and break points may additionally comprise location information and/or a reference to a point in a flight route for the secondary aircraft. If the trajectory (S4, 13:20, 15:45) is selected at block 530 the remaining list of cruise trajectories comprises: [(S1, 13:30, 14:40), (S2, 14:30, 16:00), (S3, 14:00, 16:00), (S5, 16:15, 17:00)].

At block 540, one or more cruise trajectories are selected with a t2 time that is closest to T2, i.e. (S5, 16:15, 17:00) is selected. A second route portion is then added at block 535: RP2=(S5, 2, 16:15, 17:00). At block 545, the remaining list of cruise trajectories—[(S1, 13:30, 14:40), (S2, 14:30, 16:00), (S3, 14:00, 16:00)] is filtered based on t1 values. In this case, all trajectories with a t1 value that is greater than the last break-point are ignored, i.e. if t1>16:15. If this case, there are no trajectories where this is true, so the method continues with the list [(S1, 13:30, 14:40), (S2, 14:30, 16:00), (S3, 14:00, 16:00)]. At block 550, there is a comparison of the current selected first required time of arrival (which equals the last merge-point time) and the first break-point time, e.g. in the present iteration does $M_2$<=$B_1$_16:15<=15:45—as this condition is not met the method continues.

At block 550, the t2 values of the remaining trajectories are truncated. In this case, the t2 values are truncated to 16:15 (i.e. $M_2$) if they extend beyond this time. In this particular example, all the t2 values are less than 16:15 so no truncation is applied. Block 540 is then repeated with the remaining list of trajectories—[(S1, 13:30, 14:40), (S2, 14:30, 16:00), (S3, 14:00, 16:00)]. In this case, (S2, 14:30, 16:00) and (S3, 14:00, 16:00) are closest to T2. As there are multiple entries, the entry with the longest cruise time is selected—(S3, 14:00, 16:00). In one implementation, this entry may be truncated and added to the route portions at block 540, e.g. if, for the selected entry, t1<=$B_1$ then t1 is set to $B_1$. This is the case in this example, wherein 14:00<=15:45 and so a third route portion may be added as RP3=(S3, 3, 15:45, 16:00). If truncation is required then the method may end at block 560 with the set of route portions as: [(S4, 1, 13:20, 15:45), (S5, 2, 16:15, 17:00), (S3, 3, 15:45, 16:00)], which may be time-sorted based on merge or break point times and output as [(S4, 1, 13:20, 15:45), (S3, 3, 15:45, 16:00), (S5, 2, 16:15, 17:00)]. In another case, the adding of the third route portion may be performed by not adding the route portion at block 540 but continuing with blocks 545 and 550. At block 550, the currently selected t1 value, which is 14:00 is compared to B1, which is 15:45. As the condition at 550 is met, the method may proceed to block 535, where the third route portion is truncated and added as previously described. In either case, the method then ends at block 560.

In the method of FIG. 5, blocks 540 to 555 may be seen to iteratively add route portions working from an end of a list of candidate secondary aircraft, where during iteration the list is successively truncated and filtered based on the previously added route portions, and where iteration continues until there are either no candidate route portions and/or no unshared portion of the route for the primary aircraft remaining.

Figure 6:
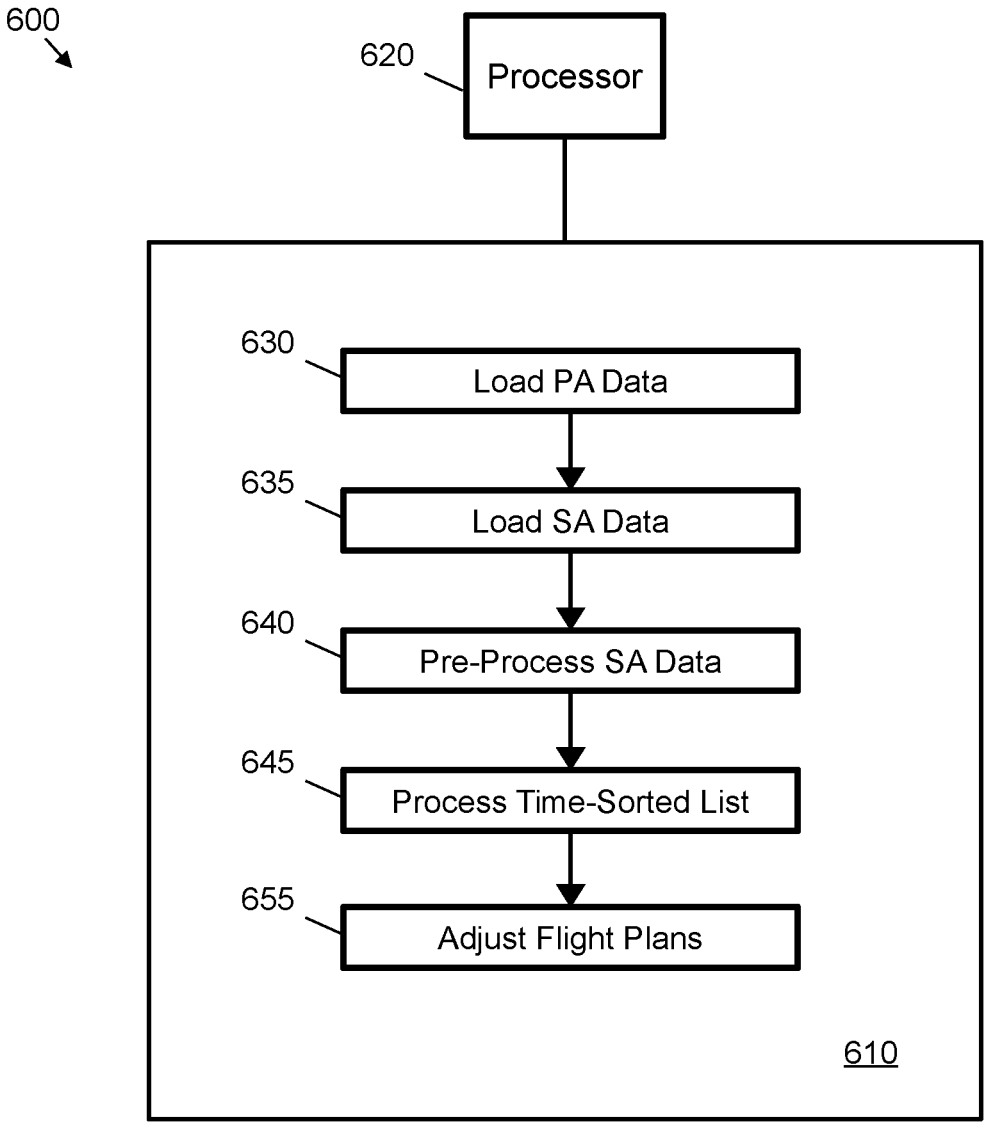
FIG. 6 shows a non-transitory computer-readable medium according to an example.

FIG. 6 shows an example 600 of a non-transitory computer-readable storage medium 610. The non-transitory computer-readable storage medium 610 stores instructions that, when executed by a processor 620, cause the processor to perform the functions described below. The processor 620 may form part of an on-board computing apparatus such as shown in FIG. 1, or a ground-based air traffic control system. The computer-readable storage medium 610 may be any electronic, magnetic, optical, or other physical storage device that contains or stores executable instructions 630 to 655. Thus, the machine-readable storage medium may comprise, for example, various Random-Access Memory (RAM), Read Only Memory (ROM), flash memory, and combinations thereof. For example, the machine-readable medium may include a Non-Volatile Random-Access Memory (NVRAM), an Electrically Erasable Programmable Read-Only Memory (EEPROM), a storage drive, a NAND flash memory, and the like. The processor may include at least one central processing unit (CPU), at least one semiconductor-based microprocessor, other hardware devices or processing elements suitable to retrieve and execute instructions stored in memory, or combinations thereof. The processor can include single or multiple cores on a chip, multiple cores across multiple chips, multiple cores across multiple devices, or combinations thereat. The processor may fetch, decode, and execute instructions from memory to perform various functions. As an alternative or in addition to retrieving and executing instructions, the processor may include at least one integrated circuit (IC), other control logic, other electronic circuits, or combinations thereof that include a number of electronic components for performing various tasks or functions.

Returning to FIG. 6, via instructions 630, the processor 620 is instructed to load data relating to a primary aircraft. The data comprises a flight plan, an altitude profile and a speed profile. The data may be loaded from an accessible memory or storage device. Via instructions 635, the processor 620 is instructed to load data relating to a set of secondary aircraft. This data also comprises a flight plan, an altitude profile and a speed profile for each of the set of secondary aircraft. Via instructions 640, the processor is instructed to pre-process the data relating to the set of secondary aircraft to generate a time-sorted list of cruise trajectories for a set of candidate aircraft. The set of candidate aircraft comprises a subset of the set of secondary aircraft. The time-sorted list of cruise trajectories may resemble the list of the worked example discussed above, e.g. that generated by one or more of blocks 520 and 525 of FIG. 5. Via instructions 645, the processor 620 is instructed to process the time-sorted list of cruise trajectories for the set of candidate aircraft to generate a list of route segments for one or more candidate aircraft. These route segments may indicate times where the primary aircraft and the secondary aircraft may share a route, e.g. may be configured to fly in formation. The route segments may comprise the route portions, e.g. as output by the worked example above. Via instructions 655, the processor 620 is instructed to adjust flight plans of one or more of the primary aircraft and a candidate aircraft associated with a given route segment in the list of route segments so as to maintain a predetermined common distance for the given route segment. For example, the processor 620 may be instructed to modify the loaded data to allow formation flying as described with reference to FIGS. 3B and 3D.

In certain cases, the medium 610 includes instructions that cause the processor 620 to select a cruise trajectory within a predetermined threshold of a top-of-climb time from the data relating to a primary aircraft based on a maximum time of flight. The processor 620 may then be instructed to, for any remaining cruise trajectories in the time-sorted list of cruise trajectories, select a cruise trajectory within a predetermined threshold of a top-of-descent time from the data relating to a primary aircraft based on a maximum time of flight. This may comprise the selection of an earliest and latest shared portion as described above. Lastly, in this case, the processor 620 may be instructed, for any remaining cruise trajectories in the time-sorted list of cruise trajectories, to iteratively truncate timings within the remaining cruise trajectories based on the selected cruise trajectories and select additional cruise trajectories based on a maximum time of flight for the truncated timings, wherein the selected cruise trajectories and their associated secondary aircraft are used to generate the list of route segments. As such the processor 620 may be instructed to execute a loop similar to blocks 540 to 555 in FIG. 5.

In one case, the instructions to adjust flight plans of one or more of the primary aircraft and a candidate aircraft associated with a given route segment comprise instructions that cause the processor 620 to transmit one or more of an adjusted flight plan, an adjusted altitude profile and an adjusted speed profile to one or more of the primary aircraft and the candidate aircraft. For example, this may use systems similar to those shown in FIG. 2.

In certain examples, the methods of FIGS. 4 and 5, or the instructions of FIG. 6, may be iteratively executed to repeatedly gather aircraft data for primary and secondary aircraft and repeat a pairing procedure to update merge and break points for shared route portions. This updating may comprise updating times for existing merge and break points, or removing and replacing merge and break points with new shared route portions. This may be of benefit if routes of aircraft are affected by weather and/or performance factors, which may result in merge and break points for shared route portions no longer applying.

Certain examples described herein may be used to fly aircraft with a maximised common distance. It may be used to automate airspace management and allow more aircraft to fly per unit of airspace in a given duration. This may provide better aircraft management at densely populated airports.

Certain examples described herein may be based on direct sharing of relevant parameters between aircraft, e.g. in flight. Separation distances may be set based on real-time and customizable factors, and pairing of aircraft can be dynamically configured to take into account changing conditions. For example, in a case of an airport closure, the present examples may be employed to safely control and separate aircraft when deviation from set flight routes is required. Certain examples described herein can cope with changes from a planned route, e.g. changes in speed and altitude of both primary and secondary aircraft. Certain examples herein also maximise a time that route portions are shared between aircraft, in turn maximising fuel savings and providing more efficient aircraft control.

Certain examples described herein are suitable for application in on-board computing systems. Certain examples may be applied on-line using limited computing hardware, e.g. as compared to ground control systems. Route portions are computed based on cruise trajectories during a cruise phase; cruise trajectories are typically the longest phase of a flight and are flown at a level altitude with a low number of sharp manoeuvres, this makes them suitable for use in a pairing procedure.

The term engines as described herein may be any combination of hardware and programming to implement the functionalities of the engine(s). In examples described herein, such combinations of hardware and programming may be implemented in a number of different ways, one of which includes the configuration of FIG. 6. For example, the programming for the engines may be processor executable instructions stored on at least one non-transitory machine-readable storage medium and the hardware for the engines may include at least one processing resource to execute those instructions. In some examples, the hardware may also include other electronic circuitry to at least partially implement at least one of the engine(s). In some examples, the at least one machine-readable storage medium may store instructions that, when executed by the at least one processing resource, at least partially implement some or all of the engine(s). In such examples, a computing device at least partially implementing an engine described herein may include the at least one machine-readable storage medium storing the instructions and the at least one processing resource to execute the instructions. In other examples, the engine may be implemented by electronic circuitry.

Although the disclosure herein has been described with reference to particular examples, it is to be understood that these examples are merely illustrative of the principles of the disclosure. It is therefore to be understood that numerous modifications may be made to the examples and that other arrangements may be devised whilst remaining with the scope of the invention as defined by the appended claims. Furthermore, while particular processes are shown in a specific order in the appended drawings, such processes are not limited to any particular order unless such order is expressly set forth herein: rather, processes may be performed in a different order or concurrently and blocks may be added or omitted. It is to be noted that the term "or" as used herein is to be interpreted to mean "and/or", unless expressly stated otherwise.

The invention claimed is:

1. An on-board computing apparatus for a primary aircraft comprising:

a route engine configured to provide aircraft data for a route flown by the primary aircraft;

a receiver configured to receive aircraft data for a plurality of secondary aircraft;

an aircraft pairing engine configured to pair the primary aircraft with a secondary aircraft from the plurality of secondary aircraft based on the aircraft data from the route engine and the aircraft data from the receiver, the aircraft pairing engine comprising an electronic circuitry configured to:

determine a set of candidate aircraft from the plurality of secondary aircraft based on a route similarity metric, the route similarity metric comprising a function of the aircraft data from the route engine and the aircraft data from the receiver and indicating a similarity of a route flown by one of the plurality of secondary aircraft to the route flown by the primary aircraft; and process flight times for cruise trajectories of the primary aircraft and the set of candidate aircraft determined from the aircraft data from the route engine and the aircraft data from the receiver to output route portions for a subset of the set of candidate aircraft that overlap with the route for the primary aircraft.

2. The on-board computing apparatus according to claim 1, comprising a transmitter configured to transmit an indication of route sharing to one or more of the subset of the set of candidate aircraft.

3. The on-board computing apparatus according to claim 1, wherein the route engine is configured to receive the output of the aircraft pairing engine and adjust the route flown by the primary aircraft to fly in formation with one or more of the subset of the set of candidate aircraft.

4. The on-board computing apparatus according to claim 1, wherein the aircraft pairing engine comprises:

a paired-route adjustment engine configured to select a route portion associated with one of the subset of the set of candidate aircraft and to determine, in conjunction with aircraft data supplied by the route engine, a route adjustment to one or more of the route flown by the primary aircraft and the selected route portion to maintain a predetermined flight separation, for the time of the route portion, between the primary aircraft and the one of the subset of the set of candidate aircraft.

5. The on-board computing apparatus according to claim 1, wherein the electronic circuitry is further configured to compute the route similarity metric based on one or more of, for a given secondary aircraft in the plurality of secondary aircraft:

a comparison of an altitude of the primary aircraft with an altitude of the given secondary aircraft;

a comparison of an aircraft type of the primary aircraft with an aircraft type of the given secondary aircraft; and a comparison of top-of-climb and top-of-descent times for a cruise trajectory of the primary aircraft with required times of arrival for a cruise trajectory of the given secondary aircraft.

6. The on-board computing apparatus according to claim 1, wherein the electronic circuitry is further configured to perform the following operations to process flight times:

sort the cruise trajectories of the set of candidate aircraft based on required times of arrival in the aircraft data from the receiver that are associated with a top-of-descent time for the primary aircraft to generate a list of sorted cruise trajectories; and iteratively process earliest and latest cruise trajectories in the list of sorted cruise trajectories to add route portions computed from the list of cruise trajectories to a list of output route portions based on a maximized time of flight.

7. The on-board computing apparatus according to claim 1, wherein the receiver and the aircraft pairing engine are activated iteratively during flight of the primary aircraft to output updated route portions for a subset of the secondary aircraft that represent changes in one or more of the aircraft data of the primary aircraft and the aircraft data of the secondary aircraft.

8. A method of controlling a primary aircraft comprising:

obtaining aircraft data for the primary aircraft;

obtaining aircraft data for a set of secondary aircraft;

filtering the set of secondary aircraft based on a constrained comparison of kinematics for the primary aircraft and the set of secondary aircraft derived from the aircraft data;

comparing flight timings for the filtered set of secondary aircraft to flight timings for the primary aircraft to output a set of paired route portions for a subset of the filtered set of secondary aircraft, the paired route portions indicating a potential overlap with a flight route for the primary aircraft; and for a secondary aircraft associated with one or more paired route portions from the set of paired route portions, adjusting the flight parameters of the primary aircraft so as to maintain at least a predefined separation between the primary aircraft and the secondary aircraft for the one or more paired route portions.

9. The method according to claim 8, wherein adjusting the flight parameters of the primary aircraft comprises adjusting one or more of: a flight plan, a speed profile and an altitude profile.

10. The method according to claim 8, wherein the method is repeated during movement of the primary aircraft along the flight route for the primary aircraft.

11. The method according to claim 8, wherein filtering the set of secondary aircraft comprises, for a given secondary aircraft, determining whether one or more of the following constraints are met:

that an altitude of the given secondary aircraft is within a threshold distance of an altitude of the primary aircraft;

that within a plane of flight, a flight route for the given secondary aircraft is within a threshold distance of a flight route for the primary aircraft;

that an aircraft type of the given secondary aircraft is compatible with an aircraft type of the primary aircraft; and that required times of arrival for the secondary aircraft are within a range between a top-of-climb time and a top-of-descent time for the primary aircraft.

12. The method according to claim 8, wherein comparing flight timings comprises:

obtaining, from the aircraft data for the primary aircraft, data indicating a top-of-climb time and a top-of-descent time for the primary aircraft;

obtaining, from the aircraft data for the secondary aircraft, data indicating required times of arrival for each of the secondary aircraft that are associated with the top-of-climb time and the top-of-descent time for the primary aircraft;

ordering the data for the secondary aircraft based on required times of arrival that are associated with the top-of-climb time; and iteratively selecting route portions from the ordered data for the filtered set of secondary aircraft by maximizing time periods between merge and break-away points, the merge and break-away points comprising points in time where a route portion for a secondary aircraft overlaps with the flight route for the primary aircraft.

13. A non-transitory computer-readable storage medium storing instructions that, when executed by a processor, cause the processor to:

load data relating to a primary aircraft, the data comprising a flight plan, an altitude profile and a speed profile;

load data relating to a set of secondary aircraft, the data comprising a flight plan, an altitude profile and a speed profile for each of the set of secondary aircraft;

pre-process the data relating to the set of secondary aircraft to generate a time-sorted list of cruise trajectories for a set of candidate aircraft, the set of candidate aircraft comprising a subset of the set of secondary aircraft;

process the time-sorted list of cruise trajectories for the set of candidate aircraft to generate a list of route segments for one or more candidate aircraft; and adjust flight plans of one or more of the primary aircraft and a candidate aircraft associated with a given route segment in the list of route segments so as to maintain a predetermined common distance for the given route segment.

14. The medium according to claim 13, including instructions that cause the processor to:

select a cruise trajectory within a predetermined threshold of a top-of-climb time from the data relating to a primary aircraft based on a maximum time of flight;

for any remaining cruise trajectories in the time-sorted list of cruise trajectories, select a cruise trajectory within a predetermined threshold of a top-of-descent time from the data relating to a primary aircraft based on a maximum time of flight; and for any remaining cruise trajectories in the time-sorted list of cruise trajectories, iteratively truncate timings within the remaining cruise trajectories based on the selected cruise trajectories and select additional cruise trajectories based on a maximum time of flight for the truncated timings, wherein the selected cruise trajectories and their associated secondary aircraft are used to generate the list of route segments.

15. The medium according to claim 13, wherein the instructions to adjust flight plans of one or more of the primary aircraft and a candidate aircraft associated with a given route segment comprise instructions that cause the processor to:

transmit one or more of an adjusted flight plan, an adjusted altitude profile and an adjusted speed profile to one or more of the primary aircraft and the candidate aircraft.

* * * * *